United States Patent [19]

Vickers

[11] Patent Number: 4,475,228

[45] Date of Patent: Oct. 2, 1984

[54] PROGRAMMABLE SOUND CIRCUIT FOR ELECTRONIC GAMES

[75] Inventor: Earl C. Vickers, Franklin Park, Ill.

[73] Assignee: Bally Manufacturing Corporation, Chicago, Ill.

[21] Appl. No.: 325,233

[22] Filed: Nov. 27, 1981

[51] Int. Cl.[3] ..... G10L 1/00

[52] U.S. Cl. ..... 381/51; 364/410

[58] Field of Search ..... 381/51, 53; 84/1.01; 328/167; 364/410

[56] References Cited

U.S. PATENT DOCUMENTS

| | | | |
|---|---|---|---|
| 4,250,455 | 2/1981 | Davis | 328/167 |
| 4,272,649 | 6/1981 | Pfeiffer | 179/1 |
| 4,301,328 | 11/1981 | Dorais | 381/51 |

OTHER PUBLICATIONS

Stout, D. F. and Kaufman, M., *Handbook of Microcircuit Design and Application,* N.Y., McGraw-Hill, 1980, pp. 8-8 to 8-11.

Alles, H. G., "Musical Synthesis Using Real Time Techniques," *Proceedings IEEE,* vol. 68, No. 4, (Apr. 1980), pp. 438-441.

Lancaster, D., *Active Filter Cook Book,* Indianapolis, Howard W. Sams & Co., 1975, Ch. 3 and pp. 200-203.

General Instrument Corp., AY-3-8910/8912, *Programmable Sound Generator for Data Manual,* 1979, pp. 1-61.

Chamberlain, H., *Musical Applications of Microprocessors,* Rochelle Park, N.J., Hayden Book Co., 1980, pp. 443-447.

*Primary Examiner*—E. S. Matt Kemeny

*Attorney, Agent, or Firm*—Welsh & Katz, Ltd.

[57] ABSTRACT

A sound generator for use with microprocessor controlled amusement games includes a programmable sound generator and programmable filters. The programmable filters utilize duty-cycle-controlled resistors to provide analog filtering under microprocessor control. Resistor duty cycles are made variable over a wide range by means of aperiodic clocking signals.

8 Claims, 4 Drawing Figures

PROGRAMMABLE SOUND CIRCUIT FOR ELECTRONIC GAMES

BACKGROUND OF THE INVENTION

This invention relates to electronic games with programmable sound circuitry. More particularly, it relates to circuitry for filtering digitally generated electronic signals used to synthesize noise and other sounds in amusement games, such as arcade games. Yet more particularly, it refers to circuitry for microprocessor control of sound generation and filtering in amusement games.

Amusement games often have associated sound generating means to add to the enjoyment of playing. The sound generation means may be used to simulate explosion sounds in war-type games, to make noisy sounds to heighten the tension of playing the games, or to provide other sound accompaniment for the games.

Sound generation under microprocessor control is possible with commercially available chips such as the AY3-8910, a programmable sound generator ("PSG"). The PSG has a plurality of output channels and may be used to generate a square wave of a designated frequency in each channel. The PSG is also capable of generating a "noise" signal comprising a frequency modulated pseudo-random pulse width rectangular wave on one or more channels. A capability is provided for amplitude modulating the channel outputs and for mixing the noise signal with a square wave signal in each channel. The PSG output may be used as input to an amplifier driving a speaker system for sound generation. The AY3-8910 is manufactured by General Instrument Corp., Hicksville, N.Y.

There are several difficulties involved in using unfiltered square wave or noise signals, such as those generated by the AY3-8910 as direct input to an audio system. Part of the difficulty lies in the fact that a sequence of square waves has high frequency components which make the resulting sounds harsh and unpleasant to listen to. Secondly, because of the high frequency components when using unfiltered rectangular waves as input, it is difficult or impossible to simulate sounds of explosions which are dominated by low frequency components. Furthermore, many naturally occuring pitched sounds may be best imitated by the additive synthesis technique of combining several channels of sinusoidal (or near-sinusoidal) waves, each tuned to a separate harmonic of the desired fundamental frequency.

Most of the aforementioned difficulties may be overcome simply by the use of programmable electrical filters. For example, a low pass filter with its cut-off set just above the fundamental frequency of a square wave will pass a pure sinusoidal signal of that frequency. Corresponding filters may be utilized to pass the fundamental and a selected number of harmonics. If, however, there are only a limited number of channels of output, as with the AY3-8910, the use of filters of fixed cut-off frequency, or fixed band-pass width in the case of band-pass filters, could only provide a very limited number of possible outputs.

Programmable digital filters are known, but these are relatively expensive and complex because of the number of calculations required. On the other hand, analog filters are relatively simple and inexpensive, primarily because a high degree of precision is not required. It is, therefore, desirable to build filters operating upon conventional analog principles but subject to rapid digital control and using inexpensive components.

SUMMARY OF THE INVENTION

An embodiment of the present invention comprises a sound circuit including low pass filters which utilize the repetitive opening and closing of switches to determine the cut-off frequency of each filter. The filters utilize the principle that if a resistor is rapidly switched on and off, the effective conductance of the resistor and switch is directly proportional to the fraction of time the switch is connected, which is the on-time, or duty-cycle time, of the resistor. The duty cycle may be varied to vary the characteristics of the filters. The use of variable duty-cycle resistor switching for filter purposes has been described by Don Lancaster, *Active-Filter Cookbook*, p. 203 (Sams & Co. 1975).

The preferred embodiment includes a clocking means which provides a basic clock rate for the sound circuit. A secondary clock rate which is some small fraction of the basic clock rate is also provided. Both rates are substantially higher than the highest acoustic frequency audible to humans, so that the digital circuitry involved in the present invention will not generate inherent audible noise. The time period between the secondary rate pulses defines the system cycle time. The time period between basic clock pulses correspondingly defines a system subcycle time.

A specific construction of the preferred embodiment includes AY3-8910 PSG's generating sound, under microcomputer control, on a number of parallel sound channels. Each channel may carry a square wave having a particular repetition rate or fundamental frequency. The repetition rate of each square wave may be varied over a time period that is long compared with the basic cycle time. Each channel may also carry a noise signal in addition to or instead of the square wave. The signal in each channel may be amplitude modulated. The square wave fundamental frequencies will lie within a range audible to humans, that is, substantially less the 20 kHz.

In the specific construction of the preferred embodiment, each channel feeds a programmable low-pass filter. The filter outputs are mixed and fed to amplifiers which, in turn, drive loudspeakers. It is, accordingly, an object of the present invention to provide a microcomputer controlled sound system for use with amusement games.

It is also an object of the present invention to provide programmable filters for use with amusement game sound systems.

It is also an object of the invention to provide such filters having electrical characteristics controllable by a microprocessor.

It is a further object of the invention to provide inexpensive programmable filters suitable for use in arcade type amusement games.

These and other objects, advantages, and features of the invention, as well as many of the particular advantages, will become readily apparent from consideration of the following detailed description particularly when taken in conjunction with the accompanying drawings.

DETAILED DESCRIPTION

Figure 1:
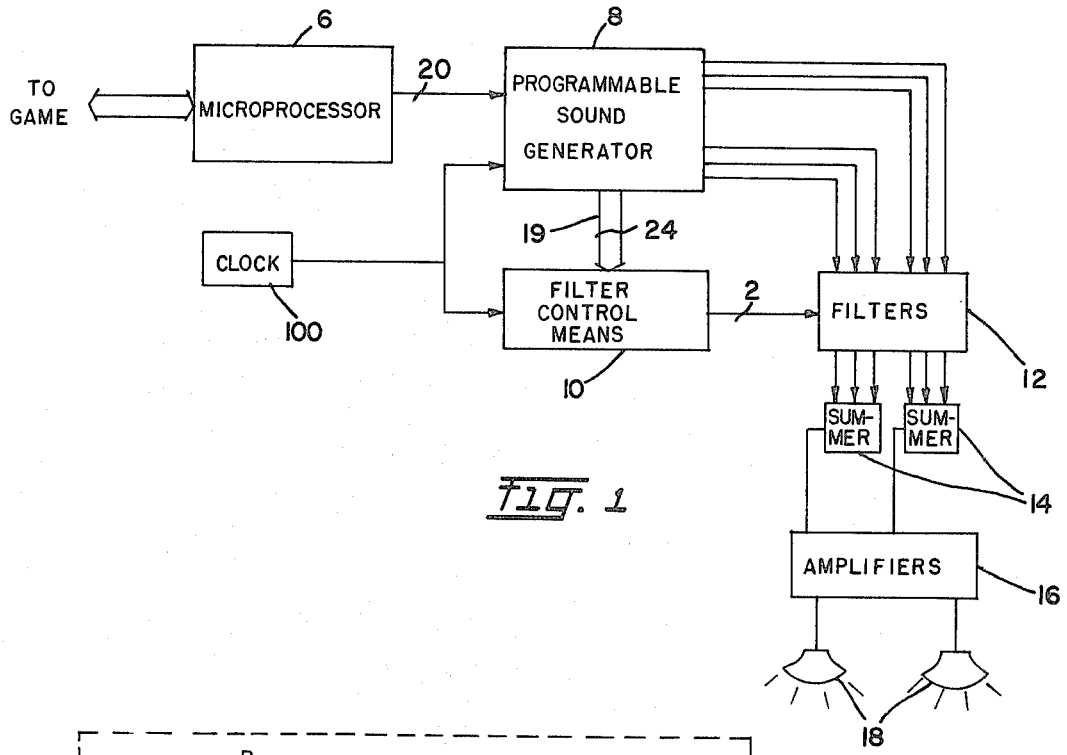
FIG. 1 is a diagrammatic illustration of the major components of a programmable sound circuit for an amusement game in accordance with the present invention.

As shown in the diagrammatic illustration of FIG. 1, a sound circuit having 6 channels constructed in accordance with the present invention may comprise a microprocessor 6 with associated memory and latches, a programmable sound generator 8, filter control means 10, a plurality of low-pass filters 12, which output to a pair of summers 14, and amplifiers 16 which amplify the output of the summers to drive a pair of loudspeakers 18. A filter data bus 19 carries 24 channels of preset data from the sound generator 8 to the filter control means 10. A digital clock 100 provides the basic clock rate for the circuit. There are six filters in the plurality of filters 12, one for each channel.

Figure 2:
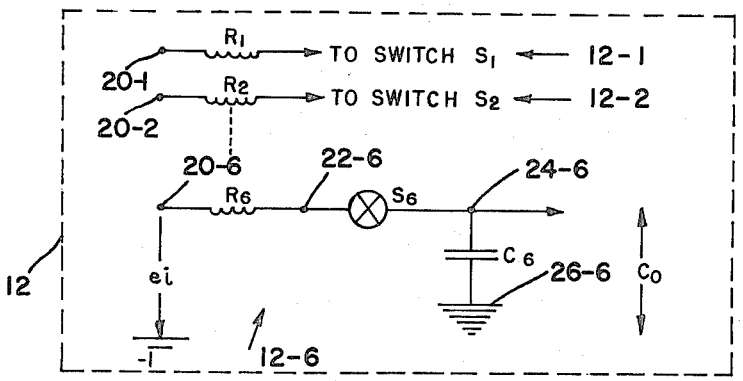
FIG. 2 is a representation of a simplified circuit illustrating low-pass duty-cycle-controlled resistor filters for the sound circuit in FIG. 1.

As shown in FIG. 2, each of the low-pass filters 12-1 to 12-6 of the plurality of low-pass filters may comprise a resistor $R_1$–$R_6$ having one terminal attached to a respective input terminal 20-1 to 20-6 at which an input voltage is applied. The other terminal 22-1 to 22-6 of the resistor connects to a respective switch $S_1$ to $S_6$ which can be turned on and off at frequencies approaching one megahertz. The switch $S_1$ to $S_6$ connects the respective terminal 22-1 to 22-6 of the resistor $R_1$ to $R_6$ to a respective terminal 24-1 to 24-6 of a respective capacitor $C_1$ to $C_6$ which has its other respective terminal 26-1 to 26-6 connected to ground. It is well known that if a time dependent voltage is applied at a terminal 20, substantially only the low frequency components of the voltage will appear at the respective terminal 24. The cut-off frequency is given by $$f_0 = 1/R_{eff}C = y/RC \quad (4)$$

where $R_{eff}$ is the effective resistance of the resistor-switch combination, y is the on time, that is, the fraction of time that the switch conducts, and $f_0$ is the cut-off frequency of the filter. Alternatively, the filter may comprise two stages instead of one and may feed the non-inverting terminal of an op-amp as shown by Lancaster, Ch. 3.

Figure 3:
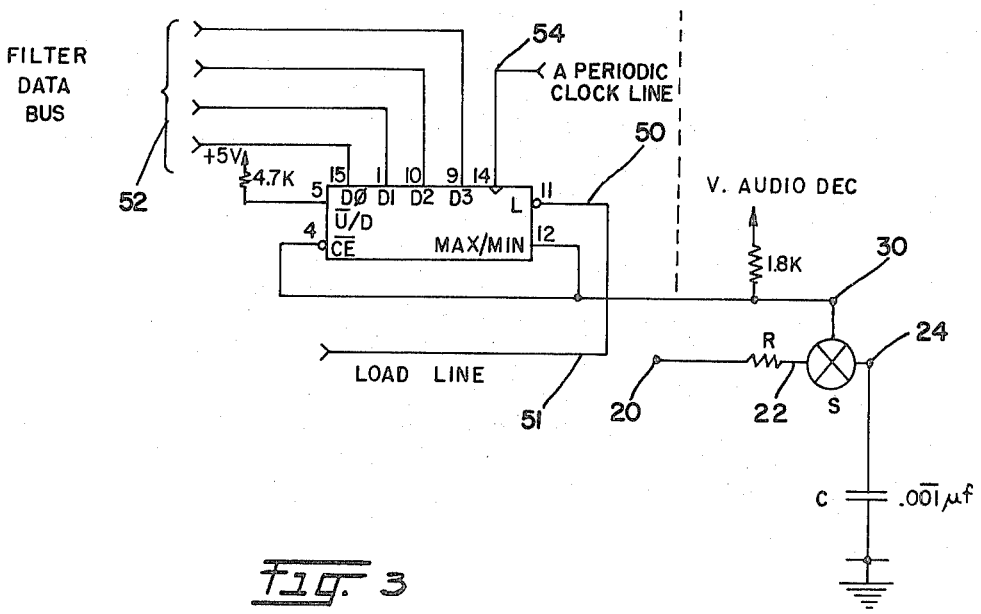
FIG. 3 is a circuit diagram illustrating one of the low-pass duty-cycle-controlled resistor filters of FIG. 2 with timing means for controlling the duty cycle.

FIG. 3 illustrates a specific construction of a timing means circuit for controlling the conducting time of a respective switch ($S_1$–$S_6$) The control pin 30 of the switch S is connected to a respective synchronous up/-down counter 50 with down/up mode control pin 50-5 and max/min pin 50-12. The counter load pin 50-11 is connected to a load line 1. The D0 through D3 data pins, 50-15, 50-1, 50-10 and 50-9, respectively, may be connected to four data lines 52 from the filter data bus 19 carrying a binary number between 0 and 15 from the data bus to the data pins. The counter clock pin 50-14 may be connected to an aperiodic clock line 54, as discussed below in connection with FIG. 4. The max/min pin 50-12 also feeds back to the counter enable pin 50-4.

A sequence of momentary low logic pulses is transmitted on the load line 51 at the secondary clock rate. The time between each adjacent pair of pulses in the sequence is substantially constant, thereby establishing a timing cycle for operation of the cycle control circuit. Each time a low pulse is transmitted on the load line, the counter 50 loads the number contained on the lines from the data bus 52. For the purpose of illustration, it may be supposed that the number loaded is a binary two, that is, the line to pin 1 is high, and the other data lines are low. Persons familiar with counters such as the Texas Instruments SN74191 will appreciate that the counter will count downward as it is clocked if the down/up pin 50-5 is pulled high, as shown in FIG. 3.

During the time of a single cycle, a sequence of pulses, generally not equally spaced in time, is carried from the aperiodic clock line 54 to the counter clock pin 50-14. The time between a pair of successive pulses in the sequence defines an aperiodic subcycle. The sum of the aperiodic subcycles within each secondary cycle is substantially equal to the time of the secondary cycle. In an extreme case there could be only a single aperiodic subcycle. As each pulse transitions from low to high, the counter counts downward one digit. Because the counter was originally set to a 2, the second pulse on the clock pin 50-14 will set the counter to zero, at which time it will transmit a high on the line from the max/min pin 50-12. The high will be carried to enable pin 50-4, thereby disabling the counter and locking the high signal on pin 50-12. The high signal is also carried to the switch control pin 30, closing the switch S.

When the next low pulse in the sequence of low pulses is applied to the load pin 50-11 by the load line, the contents of the lines from the data bus 52 are again loaded into the counter 50, and the sequence starts anew.

It may be seen that if the data carried on the data lines had been a zero, then the switch would have been closed throughout the time of a cycle between low pulses on the load line, thereby providing a 100% duty cycle for the resistor-switch combination. The four lines from the data bus therefore provide for a choice among sixteen different duty cycles, of which the longest will necessarily be 100%. It is evident that if the aperiodic clock line 54 signals are not equally spaced the duty cycle time of a resistor switch combination will depend upon the length of the aperiodic subcycles and the value of the initial data if that value is different from zero.

Figure 4:
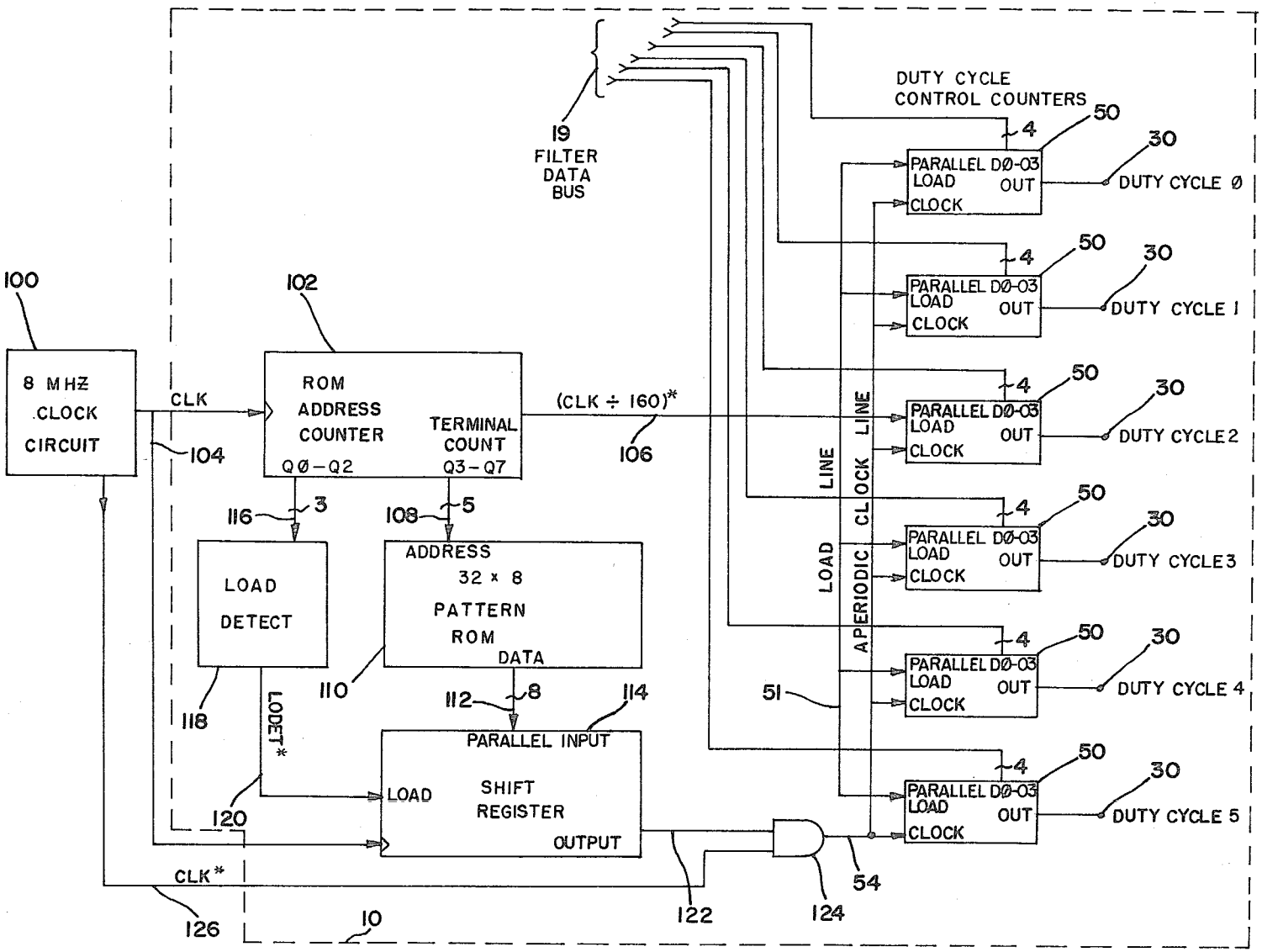
FIG. 4 is a circuit diagram illustrating filter control means comprising a six-channel circuit which includes six low-pass duty-cycle-controlled resistor filters as shown in FIG. 3, with pattern means for varying the duty cycles in accordance with a predetermined pattern.

FIG. 4 illustrates filter control means 10 for controlling six low-pass filters, such as the one just described, in cooperation with the clock 100.

The basic clock rate for a specific construction is provided by the eight MHz clock 100 clocking a ROM address counter 102 on a CLK line 104. The counter 102 is set to count from zero to 159 and then turn over, resetting to zero. The turn-over signal is transmitted to the load line 51 as a low pulse during the time the 160th clock pulse is high on a (CLK 160)* line 106.

The most significant five bits of the 8-bit output of the ROM address counter 102 are carried on a line 108 to the address pins of a 32×8 pattern ROM6 110. The locations addressed in the pattern ROM will therefore only change with every eighth pulse of the eight MHz clock. It follows that only the first 20 addresses in the pattern ROM 110 will be addressed because the ROM address counter 102 turns over every 160th count.

The eight bits of data output from the ROM 110 are carried on a register bus 112 to the input pins of an 8-bit shift register 114, such as a Texas Instruments SN74166 device. The shift register 114 is clocked by the clock pulses from the eight MHz clock 100.

The three least significant digits from the ROM address counter 102 are carried on a timing bus 116 to a load detect circuit 118 which outputs a low signal on a LODET* line 120 when the three least significant digits are zero. That is to say, the LODET* line goes low on each eighth count of the ROM address counter 102.

When the LODET* line is low, the shift register 108 loads the 8-bits on the register bus 112 from the pattern ROM 110, putting the right-most data bit of the 8-bit ROM word on an output line 122 from the output pin of the shift register 114. The output from the shift register 114 is gated through an AND gate 124 by a signal on a CLK* line 126 which is the complement of the signal on the CLK line 104. The next seven rises on the CLK line then shifts the 8-bit word on the register bus 112 from the pattern ROM 110 from right to left onto the output line 122 from the output pin of the shift register 114. The positive pulses on the CLK* line 126 then gate in turn each of the eight bits through the AND gate 124. The output of the AND gate 124 comprises the signals on the aperiodic clock line 54.

From the foregoing discussion, it may be seen that the portion of the ROM 110 comprising the lowest 20 addresses together with the shift register 114 functions as a 160=1 ROM, the addresses of which are read cyclically and sequentially in response to the pulses from the 8 MHz clock 100. It should be evident that the spacing of logical 1-bits within the pattern ROM 110 will determine the time intervals between successive pulses on the aperiodic clock line 54. Each sequence of counts from zero to 159 from the ROM address counter 102 comprises a single cycle for control of the duty cycle resistors. The sequences, which ultimately give rise to pulses on the load line, therefore determine the secondary clock rate. The spacing in time between adjacent pairs of pulses on the aperiodic clock line determines the time of a single subcycle. The totality of subcycles during a single cycle substantially constitute that cycle.

In acoustical applications it is desirable to have the cutoff frequencies of low frequency filters separated by equal frequency ratios. Filters which have cutoffs corresponding to equal frequency ratios may be achieved by having the times of the subcycles within a single cycle decrease substantially exponentially. One pattern which may be used has all zeros in the ROM 110 except for bits 40, 71, 94, 111, 124, 133, 139, 144, 147, 150, 152, 153, 154, 155, and 156. Bits 157, 158, and 159 are zero to allow for propagation delays and to prevent false triggering. The example provides frequency cutoffs spaced at approximately one third octave intervals over a wide audio range, while requiring only 4 bits of duty cycle control information and a 4-bit counter for each additional channel. The cost per channel and increased burden on the microprocessor is consequently minimized.

The functioning of the aperiodic clock in cooperation with a set of 6 counters 50, as illustrated in FIG. 4, may be demonstrated by an example. It will be supposed that the six counters are initially to be loaded with the data 0, 2, 4, 6, 8, and 12, respectively.

When a cycle begins there is a momentary low on the load line 51. The first counter will load a 0 and be disabled throughout the cycle thereby providing a 100% duty cycle as described earlier. The remaining counters will load the data 2, 4, 6, 8, and 12. The second counter will count to 0 on the second rise of the aperiodic clock line after the load line goes high at the beginning of the cycle. That rise will occur during the 71st pulse of the 8 MHz clock. At that time the second counter will output a switch closure signal. Because there will be 89 pulses of the 8 MHz clock before the end of the cycle, the duty cycle provided by the second counter will be 89/160 which is 55.6%. The duty cycles provided by the remaining 4 counters will correspondingly be 30.6%, 16.9%, 10%, and 4.4%, respectively.

Although the construction described herein is based upon the use of a ROM addressed at a constant rate and having unequally spaced 1-bits to generate an aperiodic clock signal, other possibilities are included within the scope of the present invention. For example, a cascade of counters feeding their output through logic gates could be used to provide aperiodic signals either with or without the aid of the ROM controlled sequencer of the present invention. Alternatively, a RAM could be used instead of a ROM, and the 1-bit locations determined and varied by the game microprocessor during the play of the game. As a further example, it is not necessary to the invention that the basic timing come from an 8 MHz clock nor that the ROM address counter function as a divide by 160 counter. Other types of memory may be used with or without a memory controlled sequencer. The aperiodic clock may output signals having other than exponential spacings. The use of the particular circuit components described herein are also not necessary features of the present invention. Accordingly, it should be understood that modifications of the present invention in its various aspects will be apparent to those skilled in the art, some being apparent only after study and others being a matter of routine design. As such, the scope of the invention should not be limited by the particular embodiment and specific construction herein described, but should be defined only by the appended claims and the equivalents thereof.

What is claimed is:

1. A sound generator for game controlled by a microprocessor, comprising;

first clocking means for providing a clock rate with a system cycle time period defining a system cycle, second clocking means for providing clock signals dividing each of said system cycle times into a sequence of at least two subcycles, the time duration of each subcycle in said sequence substantially conforming to a preselected sequence of time durations, sound generating means for generating electrical digital signals having fundamental frequencies in the audio range on each of a plurality of channels, a plurality of programmable filter means, each coupled to a respective channel, for independently filtering the respective signals on such channel with filter characteristics controlled by said microprocessor in accordance with the play of said game to produce a respective filtered output signal, wherein each of said programmable filter means comprises at least one duty-cycle-controlled resistor having an effective conductance proportional to said on-time, and filter control means for controlling the on-time of each duty-cycle-controlled resistor during the time duration of each system cycle so that said on-time is substantially equal to a sum of respective subcycles of said sequence of subcycles, said sum including at least one such subcycle, summing means for mixing and amplifying said filtered output signals to provide electrical analogue signals, and loudspeaker means for converting said electrical analoque signals into audible sound.

2. A sound generator in accordance with claim 1 wherein said programmable filter means includes at least one low pass filter.

3. A sound generator according to claim 1 wherein said second clocking means comprises a cascade of digital counters.

4. A sound generator according to claim 1 further comprising basic clock means for providing a basic clock rate and, wherein said second clocking means comprises a ROM clocked at an integer sub-multiple of said basic clock rate, said ROM having logical 1-bits spaced in ROM storage with separations proportional to the time durations of said subcycles in said preselected sequence of time durations.

5. A sound generator according to claim 4 wherein said integer sub-multiple is greater than 1 and the output of said ROM comprises the input to a parallel-to-serial shift register clocked at said basic clock rate.

6. A sound generator according to claim 1 wherein said second clocking means comprises a RAM, said RAM having logical 1-bits spaced in RAM storage by said microprocessor with separations proportional to the time durations of said subcycles in said preselected sequence of time durations.

7. A sound generator according to one of claims 1, 3, 4, 5, or 6 wherein each said duty-cycle-controlled resistor includes switching means and each said filter control means comprises a counter connected to said switching means of said duty-cycle-controlled resistor, and wherein said counter counts from a preset number to an ending number under control of said second clocking means, actuates said means upon reaching said preset number and reloads said preset number at the beginning of each of said system cycles, deactivating said switching means in the process of reloading said preset number when said preset number is different from said ending number.

8. A sound generator according to claim 1 wherein the time duration of successive subcycles within each system cycle decrease substantially exponentially.

* * * * *